US006652135B2

(12) United States Patent
Poitras et al.

(10) Patent No.: US 6,652,135 B2
(45) Date of Patent: Nov. 25, 2003

(54) STIRRING APPARATUS FOR LARGE CONTAINERS

(75) Inventors: James W. Poitras, Holliston, MA (US); James V. Bengiovanni, Milford, MA (US); Peter C. Lewis, Holliston, MA (US); Dennis A. Nickerson, Medway, MA (US); Paul J. Walker, Framingham, MA (US); Robert A. Prebble, New Richmond, OH (US)

(73) Assignee: Highland Laboratories, Inc., Ashland, MA (US)

( * ) Notice: Subject to any disclaimer, the term of this patent is extended or adjusted under 35 U.S.C. 154(b) by 32 days.

(21) Appl. No.: 09/960,764

(22) Filed: Sep. 24, 2001

(65) Prior Publication Data

US 2003/0058734 A1 Mar. 27, 2003

(51) Int. Cl.[7] ..... B01F 7/16

(52) U.S. Cl. ..... 366/198; 366/203; 366/261; 366/286; 366/601

(58) Field of Search ..... 366/198, 203, 366/261, 286, 601

(56) References Cited

U.S. PATENT DOCUMENTS

| | | | | | |
|---|---|---|---|---|---|
| 1,576,525 | A | * | 3/1926 | Mayer | 366/286 |
| 2,000,645 | A | * | 5/1935 | Rector | 366/203 |
| 2,110,498 | A | * | 3/1938 | Carnahan | 366/203 |
| 3,802,272 | A | * | 4/1974 | Bischoff et al. | 366/241 |
| 4,069,854 | A | * | 1/1978 | Heighberger | 411/277 |
| 4,647,213 | A | * | 3/1987 | Hay, II | 366/286 |
| 4,708,023 | A | * | 11/1987 | Schneider et al. | 73/863.31 |
| 4,740,088 | A | * | 4/1988 | Kelly, Jr. | 366/203 |
| 4,879,917 | A | * | 11/1989 | Eppelmann et al. | 366/343 |
| 4,893,939 | A | * | 1/1990 | Burk et al. | 366/286 |
| 4,924,716 | A | * | 5/1990 | Schneider | 73/866 |
| 4,964,310 | A | * | 10/1990 | Schneider | 73/866 |
| 5,076,107 | A | * | 12/1991 | Timmermans et al. | 73/866 |
| 5,160,198 | A | * | 11/1992 | Fillon | 366/198 |
| 5,589,649 | A | * | 12/1996 | Brinker et al. | 366/343 |
| 5,639,974 | A | * | 6/1997 | Hanson et al. | 366/207 |
| 5,682,001 | A | * | 10/1997 | Hanson et al. | 366/286 |
| 5,796,016 | A | * | 8/1998 | Muller | 366/286 |
| 5,807,115 | A | * | 9/1998 | Hu | 434/272 |
| 5,816,701 | A | * | 10/1998 | Martin et al. | 73/866 |
| 6,060,024 | A | * | 5/2000 | Hutchins et al. | 422/100 |
| 6,170,980 | B1 | * | 1/2001 | Martin | 366/241 |
| 6,303,909 | B1 | * | 10/2001 | Fernando et al. | 73/866 |

* cited by examiner

*Primary Examiner*—Tony G. Soohoo
(74) *Attorney, Agent, or Firm*—John E. Toupal; Harold G. Jarcho

(57) ABSTRACT

An apparatus for safely handling and securely holding a multitude of large and heavy open topped pails, for loading ingredients into these pails, and for stirring the ingredients within these pails into a fully homogenized state. The apparatus is adapted for simple removal and easy cleaning of the stirring components, and to minimize mess and eliminate cross contamination.

27 Claims, 7 Drawing Sheets

STIRRING APPARATUS FOR LARGE CONTAINERS

FIELD OF THE INVENTION

The present invention relates to machines and methods for mixing fluid compounds in open-topped containers. More specifically, it is an apparatus for handling large open-topped containers that have been preloaded with an unmixed or partially mixed compound. Further, it is an apparatus for stirring these compounds efficiently and safely within these containers to homogenize the compounds.

BACKGROUND OF THE INVENTION

Certain fluid compounds, such as paints, texture paints, wallboard jointing compounds and the like, are manufactured through a process wherein most but not in all of the ingredients are deposited into industrial sized containers at the point of manufacturing. Commercial customers, such as painting and plastering contractors, prefer to purchase these compounds in such high-volume containers for economy, consistency, and ease of use. Plastic five-gallon pails are commonly used for this purpose.

The use of such large containers can pose a burden for the manufacturer since each container necessitates the dedication and storage of so much valuable inventory. For this reason, manufacturers generally load only those ingredients common to all variations of a given compound into the pails at the time of initial manufacture. More dedicated ingredients, such as color pigments, can be added later, at the time of sale of an individual pail or a certain sized lot of pails.

After loading the unmixed or incomplete ingredients into the pails, they are covered and stored in this incomplete state until such time as it is necessary to add those dedicated ingredients.

Texture paint, for example, might be originally prepared in a natural base color, allowing the manufacturing facility to make an entire production run in that natural color and store the uncolored paint from which any final color can be created. Then, if the manufacturer gets an order for a certain quantity of this texture paint in a specified color, he only needs to add the appropriate pigments to the exact number of pails ordered, and to mix that pigment into only those pails.

Alternatively, the manufacturer often wholesales these uncolored pails in pallet quantities to retailers who mix the pigments into individual pails as the pails are purchased by contractors, much the same way that pigments are mixed into one gallon buckets for sale to consumers.

There are several drawbacks to the use of such large pails. First, they are heavy and may not fit within standard mixing machines. Second, such large pails full of such viscous compounds as texture paint do not properly mix when shaken as does ordinary paint, the contents must be stirred for full homogenization to occur. Third, the complete and expedient stirring of such viscous compounds in such large pails into a fully homogenized state is neither easy nor efficient with existing machinery. Fourth, the stirring of such compounds and weight of the pails present safety concerns. Fifth, the stirring of such compounds is inherently messy and the resulting mess is difficult to clean-up. And sixth, stirring generally poses a likelihood of cross-contamination between batches when the stirring blade carries ingredients from one pail into the next.

OBJECTS AND SUMMARY OF THE INVENTION

The present invention is an apparatus for handling large pails of viscous compounds and for thoroughly and expediently stirring these compounds into a fully homogenous state. More specifically, it is an apparatus adapted to safely handle and securely hold a multitude of large and heavy open-topped pails, to load ingredients into these pails, and to stir the ingredients within these pails into a fully homogenized state. Further, the apparatus is adapted for simple removal and easy cleaning of the stirring components, to minimize mess and to eliminate cross contamination.

It is an object of the present invention to provide a means for the safe and easy handling of such large pails.

It is another object to mix the compounds within the pails thoroughly, evenly, and rapidly.

It is another object to reduce the mess that normally results from mixing such compounds and to simplify clean-up.

It is another object to eliminate cross-contamination when stirring later batches of compounds having different ingredients.

Further objects and advantages of the present invention will be best appreciated and more fully understood in reference to the herein described preferred embodiment and the appended drawings, of which the following is a brief description.

BRIEF DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT OF THE INVENTION

Figure 1:
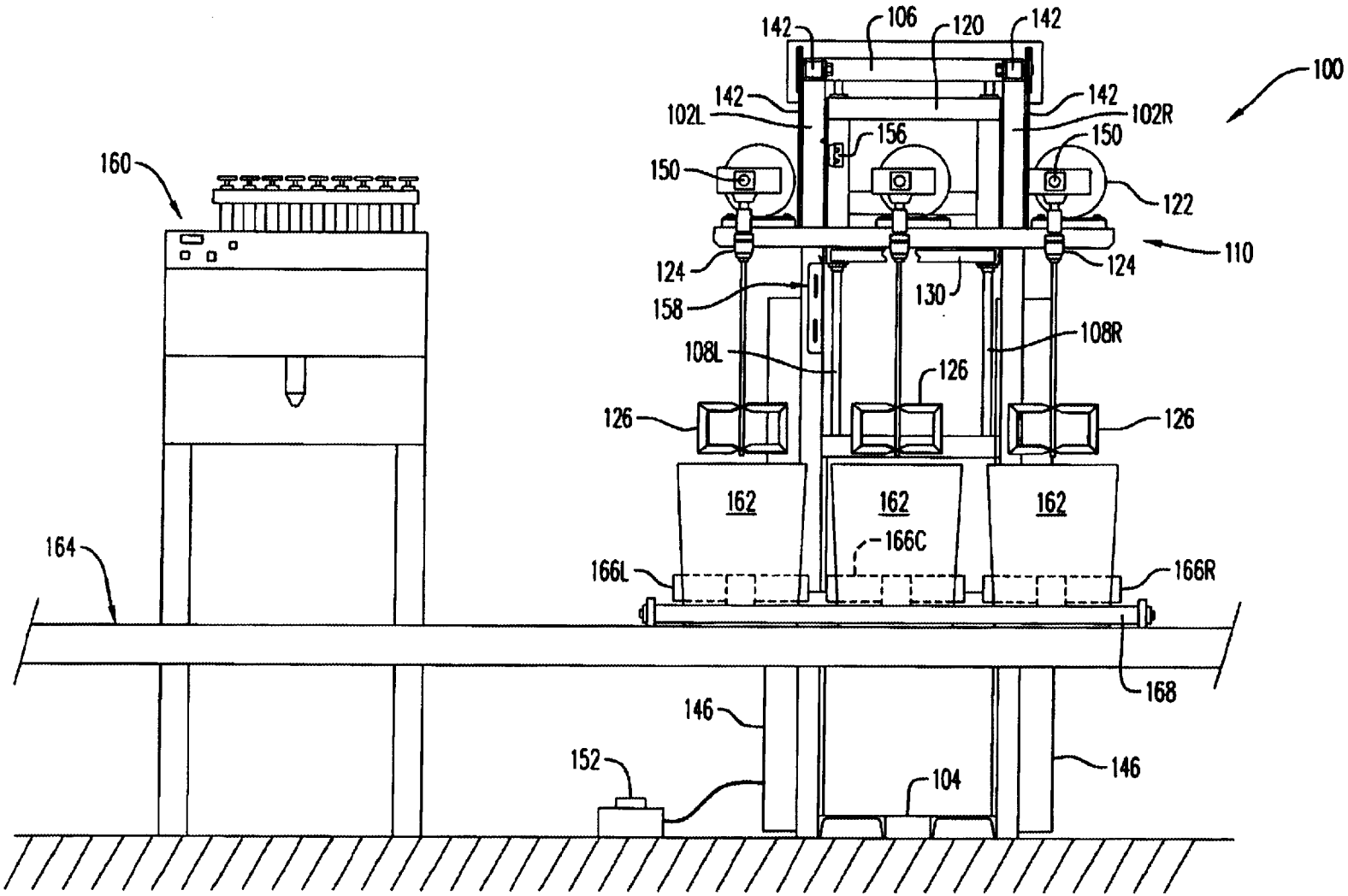
FIG. 1 is a front elevation of a stirring apparatus according to the preferred embodiment of the present invention.
Figure 2:
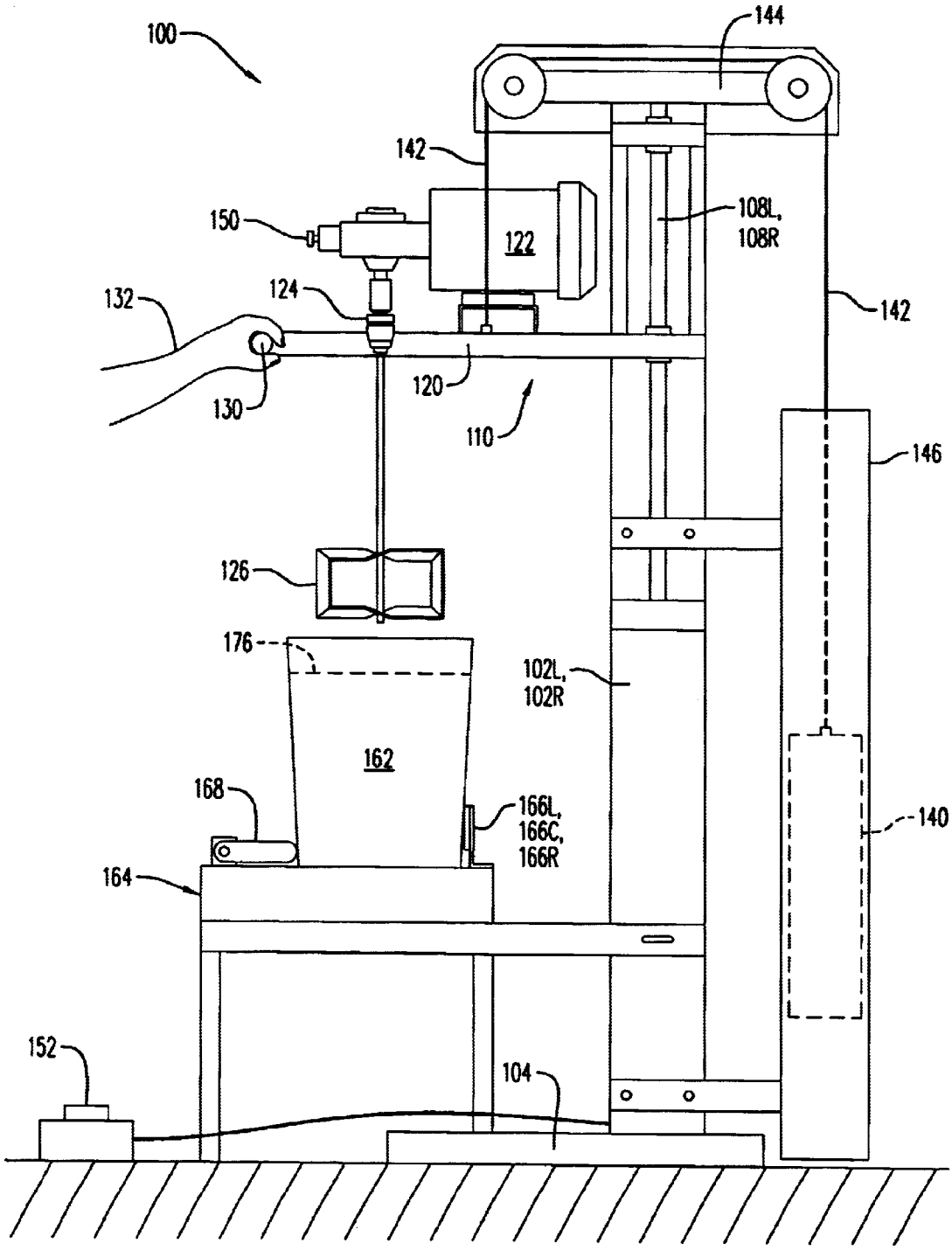
FIG. 2 is a right side view of the apparatus of FIG. 1 with an operator's arm prepared to lower the stirring head.
Figure 3:
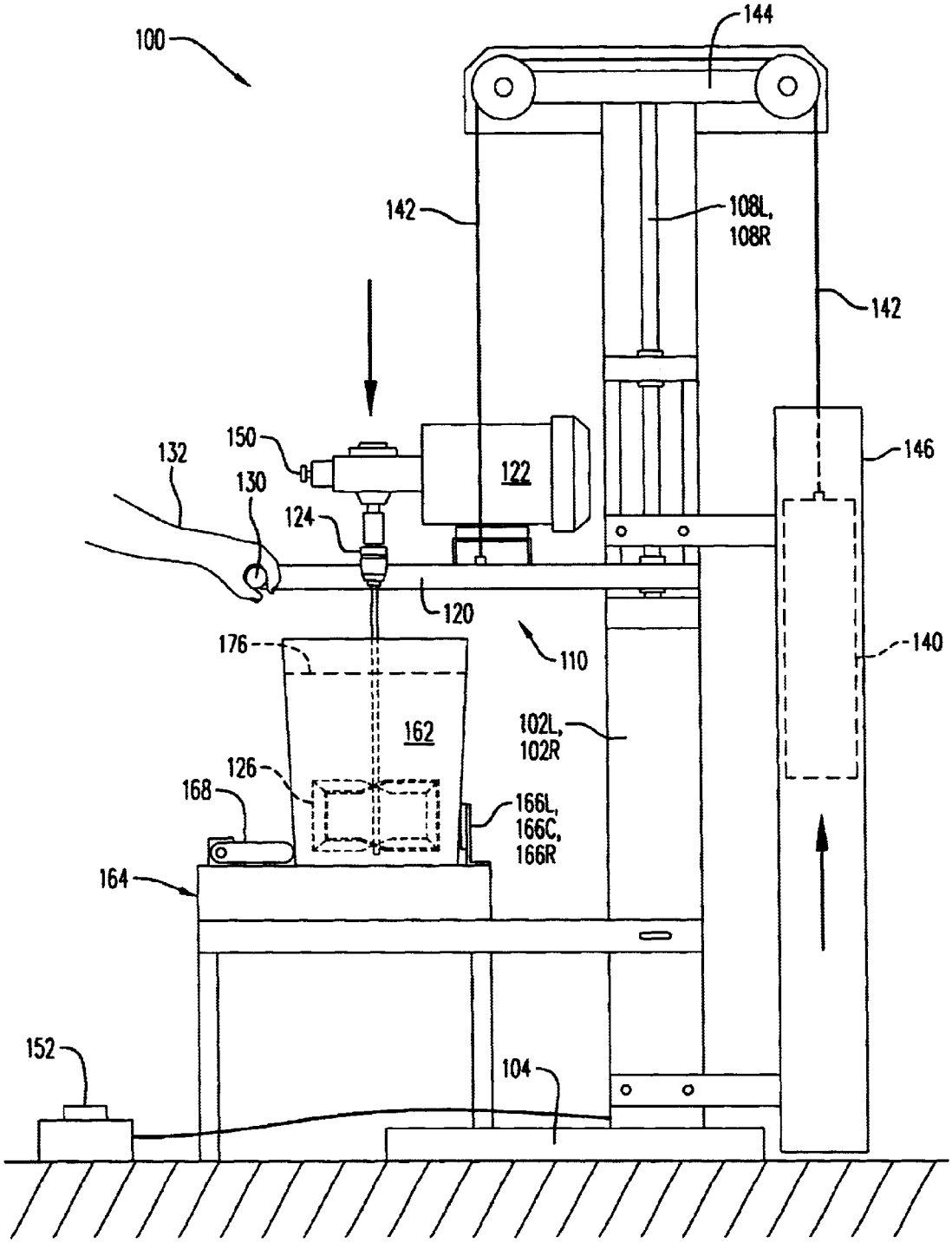
FIG. 3 is a right side view similar to FIG. 2, but with the stirring head lowered into the pail by the operator.
Figure 4:
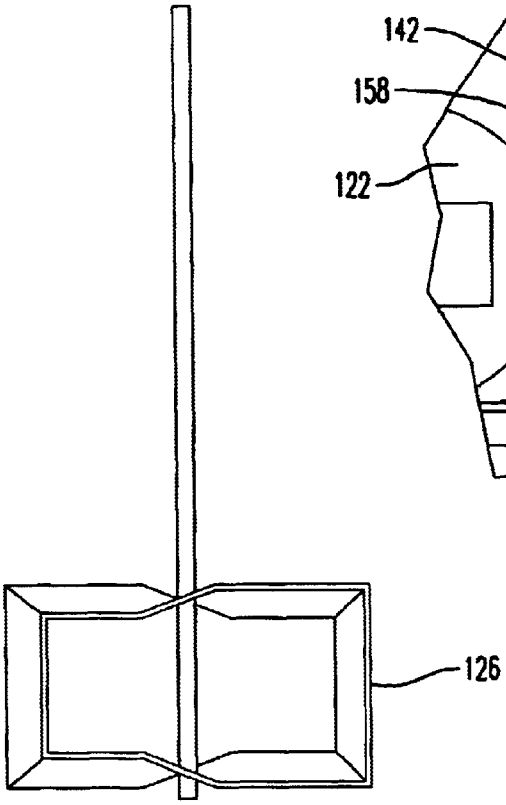
FIG. 4 is an enlarged view of one of several types of stirring blades of the apparatus of FIG. 1.

The preferred embodiment of the present invention is best understood with reference to FIGS. 1 through 9.

The main frame of mixing apparatus 100 comprises two vertical beams 102L and 102R that are welded at the bottom to base 104 and at the top to header beam 106. Vertical guide slots 108L and 108R are affixed to the inner walls of the vertical beams to guide the vertical movement of stirring head 110.

The stirring head comprises a support frame 120 onto which are mounted three right-angled drive motors 122 that are equipped with quick-release stirring blade chucks 124. The chucks accept stirring blades 126 in a vertically depending orientation. The chucks are similar to standard keyless drill chucks and allow the operator to quickly affix and remove the blades without the need for a tool.

The stirring head support frame 120 includes handle 130 to allow an operator 132 to raise and lower the stirring head within guide slots 108L and 108R.

The stirring head 110, including all of its components, weighs approximately 300 pounds. To enable an operator to raise and lower it, it is counterbalanced by counterweights 140 which are attached to the head by cables 142 that are routed of idler pulleys 144 affixed to counterbalance beams 144 welded to the top of vertical beams 102L and 102R. The counterweights are contained but free to move vertically within steel tubes 146. Thus, the stirring head is effectively weight-free to the operator as it is raised and lowered.

Energizing the drive motors causes the stirring blades to spin. The drive motors are each equipped with safety shut-off switches 150 so that an operator can instantly de-energize the motors in an emergency. Foot-actuated shut-off switch 152 also must be depressed in order to energize the drive motors.

Figure 5:
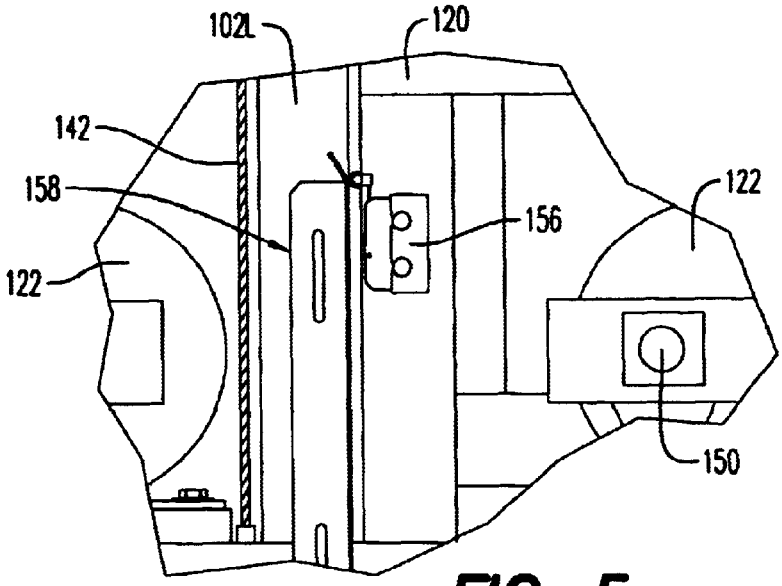
FIG. 5 is an enlarged portion of the apparatus of FIG. 1 showing detail of the stirring head vertically actuated limit switch.
Figure 6:
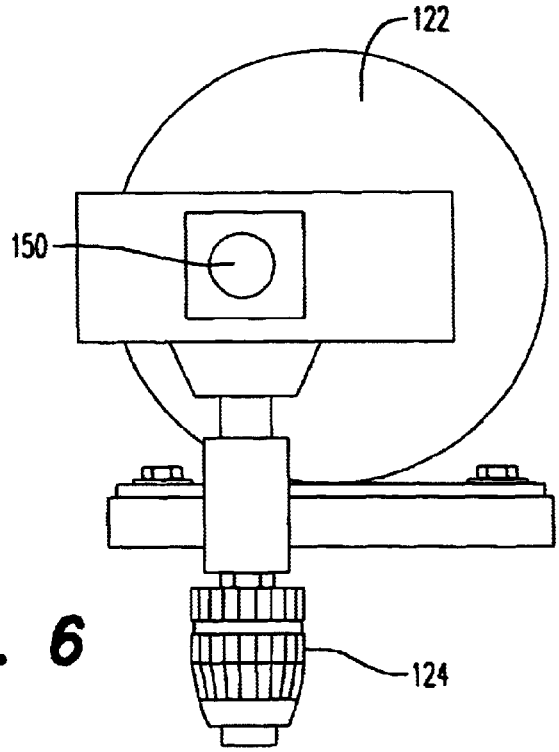
FIG. 6 is an enlarged portion of the apparatus of FIG. 1 showing detail of the quick-release chuck of the stirring head.
Figure 7:
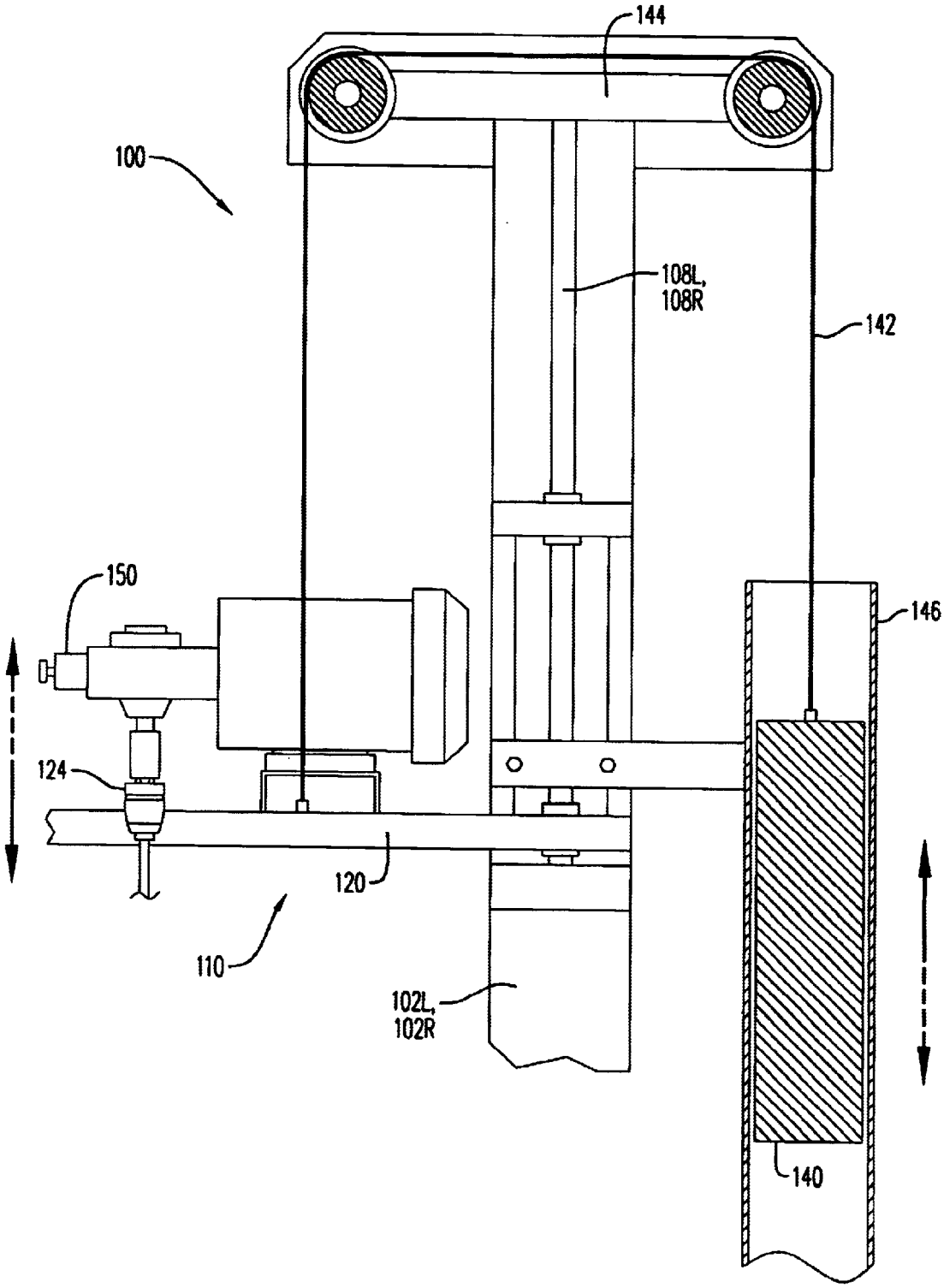
FIG. 7 is an enlarged partially sectioned side view similar to FIG. 3, which shows detail of the counterweight pulley system of the apparatus of FIG. 1.
Figure 8:
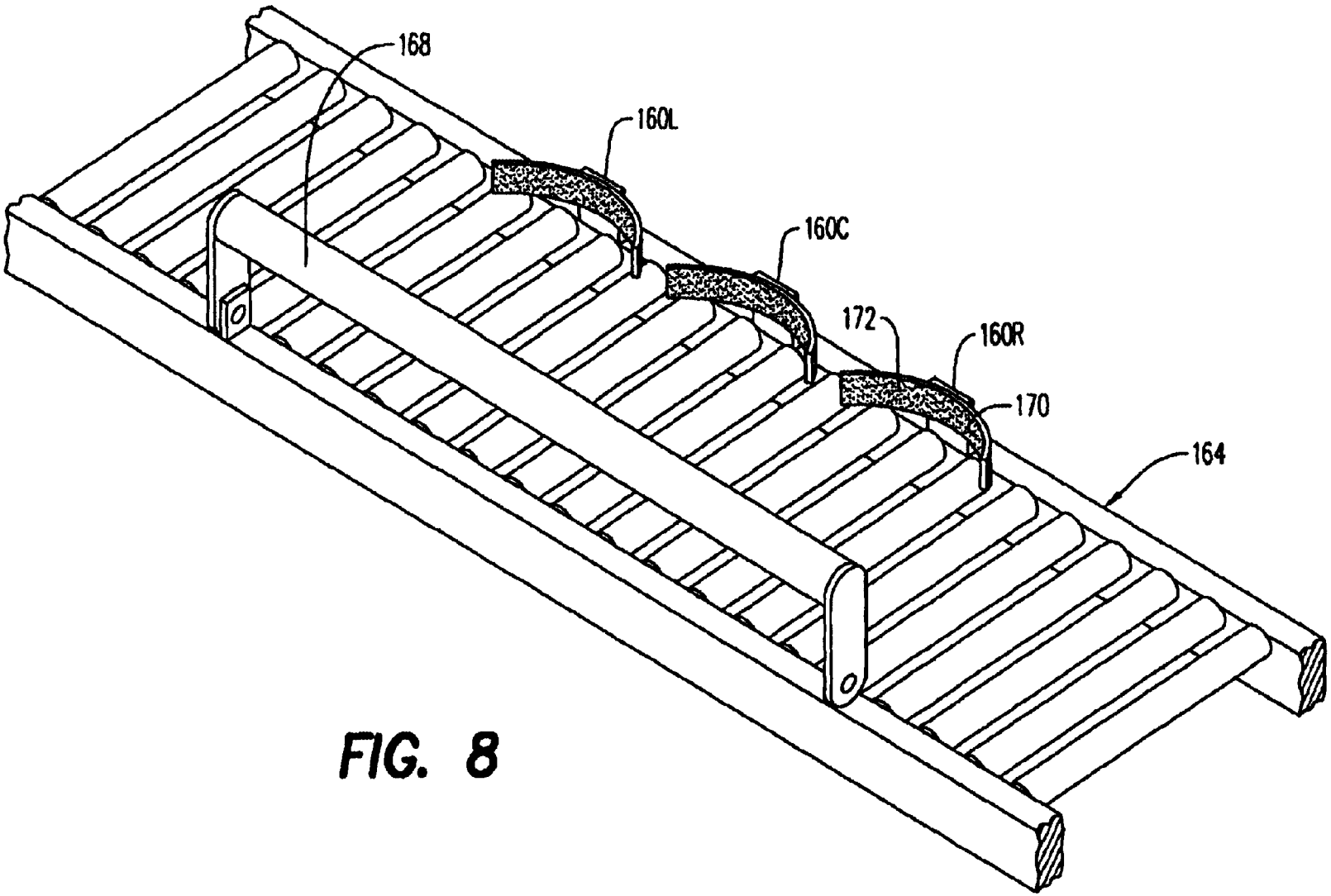
FIG. 8 is a perspective view of the transport bed of the apparatus of FIG. 1 ready to accept a pail.
Figure 9:
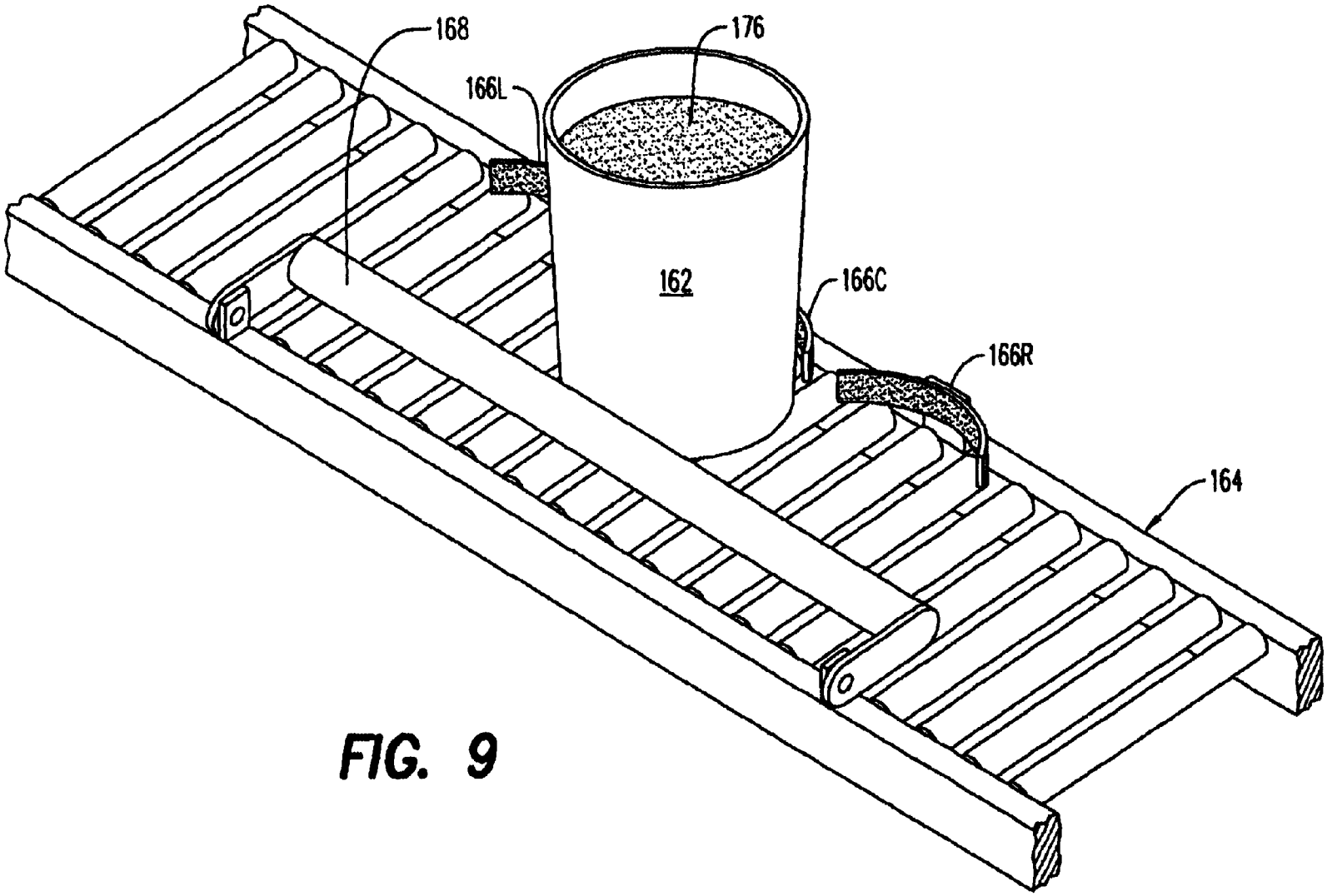
FIG. 9 is a perspective view of the transport bed of FIG. 8 with a clamped pail in place thereon.

As shown in FIG. 5, vertical movement responsive limit switch 156 is positioned so as to be engaged and actuated by actuator 158 in response to vertical movement of the stirring head 120 so that the drive motors are only energized when the paddles 126 have been lowered within the pails 162.

Pigment machine 160 is positioned to the left side of the mixing apparatus 100 for adding colorant to contents of a loaded five gallon plastic pail 162. Horizontal roller bed 164 is adapted to allow the pail to be easily pushed from a dispenser or from a "Waiting", or "Ready" position, to one of the mixing positions defined by pail holding rails 166L, 166C or 166R. Clamp roller 168 is biased towards the holding rails to rigidly hold the pail against the rail and in proper position under one of the stirring blades 126.

The pail holding rails each have a curvature that mates with the pail's base diameter, and the inner surface 170 of each rail is coated with an abrasive layer 172 to prevent the pail from spinning.

The following describes the operational sequence for blending ingredients into a single pail of some viscous compound. Initially, the blade chucks would not contain a stirring blade and all of the safety shut-off switches 150 would be deactivated to disable the drive motors.

Loaded pail 162 is placed onto the roller bed 164 at the dispenser and any ingredients are injected into the pail. The pail is then pushed along the roller bed towards the mixing apparatus while the clamp roller 168 is held away from the holding rails 166L, 166C and 166R.

Once the pail has been properly positioned against a holding rail, the clamp roller is released to firmly secure the pail against the holding rail and directly under one of the chucks 124. A stirring blade 126 is then inserted into the appropriate chuck and the operator closes the appropriate safety shut-off switch 150 and steps onto the foot-actuated switch 152.

The operator then grasps the stirring head handle 130 and lowers the stirring head so that the stirring blade 126 is lowered into the compound 176 with the pail. Once lowered enough so that the top of the stirring blade is fully within the compound, vertically-actuated limit switch 156 is closed to energize the appropriate drive motor and cause the stirring of the compound and pigment into a homogenized blend.

When the stirring is completed, the operator raises handle 130 to lift the stirring blade 126 from the blended compound. As this upward movement nears the top of the compound, vertically actuated limit switch 156 is opened to de-energize the drive motor so that the blade is no longer spinning when it rises from the compound. This is not only a safety feature, but also eliminates the mess that would otherwise occur if the compound covered blade was still spinning as it came out of the pail. The compound covered blade can then be quickly removed from the chuck and washed.

In the case where multiple pails are to be stirred in a single operation, the operator would simply insert stirring blades into the other chucks and close the other safety shut-off switches.

Finally, covers (not shown) can be placed onto the pails and the pails can be removed from the roller bed.

Those skilled in the art will recognize that there are many variations of the invention that are within the scope of the invention, therefore, the invention is to be defined only by the limitations and the equivalents thereof which the following claims set forth.

What is claimed is:

1. An apparatus for stirring ingredients within an open-topped pail and comprising:

a horizontal base for supporting said pail;

a movable stirring head comprising a rotatable stirring blade;

drive means for rotating said blade;

guide means for guiding vertical movement of said head between positions locating said blade either above or within said pail; and switching means responsive to the vertical position of said head to induce rotation of said stirring blade only when positioned in said pail.

2. An apparatus according to claim 1 wherein said switching means comprises a switch actuated by movement of said head.

3. An apparatus according to claim 2 wherein said switching means further comprises an actuator positioned and arranged to engage said switch in response to relative movement between said switch and said actuator.

4. An apparatus as in claim 3 wherein said stirring blade is rotatable about a vertical axis projecting downwardly into said pail.

5. An apparatus as in claim 3 wherein said horizontal base comprises means for securing said pail in a fixed and non-rotatable position.

6. An apparatus as in claim 5 wherein said means for securing said pail include a fixed member and a clamping member biased towards said fixed member and wherein said fixed and clamping members cooperate to clamp said pail into said fixed and non-rotatable position.

7. An apparatus as in claim 6 wherein at least one of said fixed and clamping members has a slip preventing contact surface that engages said pail to prevent said pail from rotating.

8. An apparatus as in claim 3 wherein said drive means is an electric motor connected to said stirring blade and energized by said switch to cause said stirring blade to rotate with said stirring blade lowered into said pail.

9. An apparatus as in claim 8 wherein said motor is mounted on said head.

10. An apparatus as in claim 9 wherein said stirring blade is rotatable about a vertical axis projecting downwardly into said pail.

11. An apparatus as in claim 10 wherein said horizontal base comprises means for securing said pail in a fixed and non-rotatable position.

12. An apparatus as in claim 11 wherein said means for securing said pail include a fixed member and a clamping member biased towards said fixed member, and wherein said fixed and biased members cooperate to clamp said pail into said fixed and non-rotatable position.

13. An apparatus as in claim 12 wherein at least one of said fixed and biased members has a slip preventing contact surface that engages said pail to prevent said pail from rotating.

14. An apparatus as in claim 13 wherein said electric motor and said stirring blade are releasably connected such that said stirring blade can be removed without the use of a tool.

15. An apparatus for stirring ingredients within a plurality of open-topped pails and comprising:

a horizontal base for supporting said pails;

a movable stirring head comprising a plurality of rotatable stirring blades;

drive means for rotating said blades;

guide means for guiding vertical movement of said head between positions locating each of said blades either above or within a different one of said pails; and switching means responsive to the vertical position of said head to induce rotation of said stirring blades only when said stirring blades are positioned within said pails.

16. An apparatus according to claim 15 wherein said switching means comprises a switch actuated by movement of said head.

17. An apparatus according to claim 16 wherein said switching means further comprises an actuator positioned and arranged to engage said switch in response to relative movement between said switch and said actuator.

18. An apparatus as in claim 17 wherein each of said stirring blades is rotatable about a vertical axis projecting downwardly into a corresponding said pail.

19. An apparatus as in claim 17 wherein said horizontal base comprises means for securing each of said pails in fixed and non-rotatable positions.

20. An apparatus as in claim 19 wherein each of said means for securing said pails includes a fixed member and a corresponding clamping member biased towards said fixed member, and wherein each of said fixed and corresponding clamping members cooperate to clamp said pails into said fixed and non-rotatable positions.

21. An apparatus as in claim 20 wherein at least one of said fixed or clamping members have slip preventing contact surfaces that engage said pails to prevent said pails from rotating.

22. An apparatus as in claim 17 wherein said drive means comprises one or more electric motors connected to said stirring blades and energized by said switch to cause said stirring blades to rotate with said stirring blades lowered into said pails.

23. An apparatus as in claim 22 wherein said one or more motors are mounted on said head.

24. An apparatus as in claim 23 wherein each of said stirring blades is rotatable about a vertical axis projecting downwardly into a corresponding pail.

25. An apparatus as in claim 24 wherein said horizontal base comprises means for securing each of said pails in fixed and non-rotatable positions.

26. An apparatus as in claim 25 wherein each of said means for securing said pails includes a fixed member and a corresponding clamping member biased towards said fixed member, and wherein each of said fixed and corresponding clamping members cooperate to clamp said pails into said fixed and non-rotatable positions.

27. An apparatus as in claim 26 wherein at least one of said fixed members or said biased clamping members, or both, have slip preventing contact surfaces that engage said pails to prevent said pails from rotating.

* * * * *